US008859926B2

(12) United States Patent
Freelove

(10) Patent No.: US 8,859,926 B2
(45) Date of Patent: Oct. 14, 2014

(54) HAIR EXTENSION DEVICE

(71) Applicant: Michelle Elizabeth Freelove, Battle Creek, MI (US)

(72) Inventor: Michelle Elizabeth Freelove, Battle Creek, MI (US)

(73) Assignee: Michelle Elizabeth Freelove, Battle Creek, MI (US)

( * ) Notice: Subject to any disclaimer, the term of this patent is extended or adjusted under 35 U.S.C. 154(b) by 0 days.

(21) Appl. No.: 13/720,099

(22) Filed: Dec. 19, 2012

(65) Prior Publication Data

US 2013/0104919 A1 May 2, 2013

Related U.S. Application Data

(63) Continuation of application No. 12/895,425, filed on Sep. 30, 2010, now Pat. No. 8,342,186, which is a continuation-in-part of application No. 11/791,921, filed as application No. PCT/US2006/003283 on Jan. 31, 2006, now Pat. No. 7,854,233.

(60) Provisional application No. 60/647,781, filed on Jan. 31, 2005.

(51) Int. Cl.
*A41G 3/00* (2006.01)
*A41G 5/00* (2006.01)

(52) U.S. Cl.
CPC ..... *A41G 5/0046* (2013.01)
USPC ..... 218/53; 132/201

(58) Field of Classification Search
USPC ..... 132/201, 53–56
See application file for complete search history.

(56) References Cited

U.S. PATENT DOCUMENTS

| | | | | |
|---|---|---|---|---|
| 1,351,427 | A | 8/1920 | Krasmauskis | |
| D59,261 | S | 10/1921 | Muller | |
| 1,424,845 | A | 8/1922 | Nolan | |
| 1,607,926 | A | 11/1926 | Sterling | |
| 1,638,016 | A | 8/1927 | Oppenheim | |
| 2,621,663 | A | 12/1952 | Jenkins | |
| 2,865,380 | A | 12/1958 | Mitchell | |
| 3,280,826 | A | 10/1966 | Jenkins | |
| 4,600,029 | A * | 7/1986 | Ueberschaar | 132/53 |
| 5,551,452 | A | 9/1996 | Barlow | |
| 6,830,054 | B1 * | 12/2004 | Ross-Kuehn | 132/201 |
| 2002/0100489 | A1 | 8/2002 | Minnelli | |
| 2004/0129285 | A1 | 7/2004 | Frazier | |
| 2005/0268928 | A1 * | 12/2005 | Lane | 132/53 |
| 2006/0174905 | A1 | 8/2006 | Bias | |
| 2007/0125399 | A1 | 6/2007 | Guliker | |
| 2008/0072920 | A1 | 3/2008 | Ladue | |
| 2008/0257369 | A1 | 10/2008 | Poole | |

OTHER PUBLICATIONS

International Search Report of the related International application PCT/US2010/059901, dated Feb. 2, 2011.

* cited by examiner

*Primary Examiner* — Rachel Steitz
(74) *Attorney, Agent, or Firm* — Protect it! IP, LLC; Paul Roberts

(57) ABSTRACT

In one configuration of the present invention, a hair extension device for providing a user with the appearance of having longer, fuller hair is disclosed. The device may have a hair cluster having a hair flap which in turn comprises one or more hair wefts. The hair wefts may contain a number of hair strands connected together by seams which composes the band. The device may contain a filament which may be sandwiched between one or more flaps. The hair wefts may be sewn together with thread using a zig-zag stitch for example. The hair extension device may be reversible and the wefts may be attached to a length of lace.

15 Claims, 18 Drawing Sheets

HAIR EXTENSION DEVICE

RELATED APPLICATION

The present patent application is a Continuation of Ser. No. 12/895,425, filed Sep. 30, 2010, now U.S. Pat. No. 8,342,186, which is a Continuation-in-Part of U.S. Non-Provisional patent application Ser. No. 11/791,921 (filed May 30, 2007) which is a National Phase Entry of PCT/US06/03283 (filed Jan. 31, 2006) which claims the benefit of priority to U.S. Provisional 60/647,781 (filed Jan. 31, 2005).

FIELD OF THE INVENTION

The present invention relates to a hair extension device which can be worn by a user.

BACKGROUND OF THE INVENTION

One of the most attractive features of people, especially women, has always been their hair. This fact has been known for thousands of years, which explains certain religious sects' edict to cover or even cut women's hair. For those women who are unaffected by such restrictions, however, long, luxurious human hair is an asset that results in improved appearance and self esteem. Unfortunately, due to age, disease or genetics, not everyone is fortunate enough to have a full complement of naturally hair. For those, hair pieces and wigs are often the answer.

Numerous methods and devices for creating the appearance of thicker or longer hair exist in the prior art. When adding supplemental natural or synthetic hair to that of an individual, the typical method involves applying the supplemental hair directly to the individual's natural hair, either by gluing the strands of hair to the natural hair or by bonding strands of the supplemental hair to the natural hair using a durable bonding material. Applying additional hair strands to an individual's natural hair is a meticulous process that requires hours of application time. Additionally, after time, the supplemental hair strands tend to unravel or fall out. More supplemental hair must be reapplied or the supplemental strands must be removed, often causing a great deal of damage to the individual's natural hair.

An alternate method of providing hair extensions for a user involves adding to an individual's natural hair by using hair clips to attach strands of supplemental hair to the user's natural hair. While this method is effective in providing the appearance of longer or thicker hair for the user, the addition of hair clips tends to be quite cumbersome during use. The user cannot easily wash her natural or supplemental hair with the hair clips in the hair. Moreover, adding hair clips to the hair involves excessive time.

DESCRIPTION OF THE RELATED ART

Hair extension devices exist that do not require the use of hair clips, gluing, bonding or other intrusive methods of adding supplemental hair to natural hair.

U.S. Pat. No. 1,351,427, issued Aug. 31, 1920 to Veronika Krasmauskis, describes a hair-dressing attachment for forming artificial side or ear puffs. The article consists of two switches of hair connected together by a cord or wire crossed over the head to support the switches at the side of the head so that, when the puffs are formed up from the switches, they will be in the proper position.

U.S. Pat. No. 1,424,845, issued Aug. 8, 1922 to William E. Nolan, describes transformations or wigs of the long-hair type that are worn principally by women and in contra-distinction to toupees and to other hair-dress devices employing permanently-bobbed or other set styles of hair.

U.S. Pat. No. 1,607,926, issued Nov. 23, 1926 to Bernard A. Sterling, describes a hairdressing attachment for use at the back of the head to conceal a bob and give hair that has been bobbed an unbobbed appearance. The structure may be secured in place upon the head with means for locking the attachment positively and firmly in place and against accidental displacement.

U.S. Pat. No. 1,638,016, issued Aug. 9, 1927 to Jesse Oppenheim, describes hair dressing appliances and devices employed for the attachment of hair pieces to bobbed hair so that the wearer will present, for dress or other purposes, the appearance of having long hair which may be dressed or manipulated in any desired style.

U.S. Pat. No. 2,865,380, issued Dec. 23, 1958 to Princess Mitchell, describes hairpieces and methods of hair preparation whereby a short hair dress may be rapidly converted into a long hair dress.

U.S. Pat. No. 3,280,826, issued Oct. 25, 1966 to Christina M. Jenkins, describes a hair piece composed of commercial or false hair adapted to be applied to the human head by securing the same to existing live hair.

U.S. Pat. No. 2,621,663, issued to Christina M. Jenkins, contemplates mounting on the head a base of attachment for the commercial hair by interweaving strands of live hair with a base material and then attaching a switch, weft or like accessory of commercial hair to the base. With this method, the commercial hair is permanently attached to the live hair and serves to give the live hair the appearance of greater length and thickness as well as cover bald spots, thin spots, or scars.

U.S. Pat. No. 4,600,029, issued Jul. 15, 1986 to Ueberschaar, describes a hairpiece having individual hairs adjustably secured about a circular filament. The hairpiece is then placed on the user's head, the filament sandwiched beneath an upper layer and above an underlying layer of hair on the head, so the natural hair of the user is blended with the supplemental hair on the hairpiece. Each hair is individually applied to the filament, requiring a tedious, inordinately complicated process in assembling the hairpiece. Additionally, as each hair is added to the filament individually, only a single row of individual hair strands may be attached to the filament, thereby limiting the amount of hair that is attachable to the hairpiece. As such, the thickness of the supplemental hair is restricted to the level of a single row of individual hair strands.

Therefore, there is a need for a hair extension device that avoids or eliminates the use of hair clips, glue or bonding material but provides a quick and efficient method of adding supplemental hair to a user's natural hair. Moreover, there is a need for a device that provides numerous layers of supplemental hair strands, such that the supplemental hair provided for the user may have varying levels of thickness and length.

OBJECTS OF THE INVENTION

It is an object of the invention therefore to provide a hairpiece that may be sandwiched between layers of natural hair and be invisible to an observer and supply additional volume and length of hair to the head.

A further object of the present invention is to provide means whereby the circular filament, if traversing a part line, will be virtually invisible in its crossing.

Another object of the invention is to provide means whereby the hair may be massed or distributed in lesser or greater amounts depending upon the desired hair style or problem of the wearer.

A still further object of the invention is to provide means whereby additional segments of hair may be secured as may be desired.

Another object of the invention is to provide a hairpiece of the type described which may be used as a "ponytail" or the like, or as a "bun".

A still further object of the invention is to provide means whereby the additional hairpiece may be sandwiched between layers of natural hair so that the frictional relationship of the added hairpiece on the natural hair and the fixed roots of the lapping natural hair anchors the same in the adjusted place position and the hair, with its sandwiched hairpiece in place, may be shampooed, wet, as in swimming without dislodgement of the hairpiece.

Another object of the invention is to provide means whereby hair of contrasting shades on the hairpiece may be used wherefore the effect of "streaking" in the hair is secured, if desired, without the need to bleach or color the natural hair.

SUMMARY OF THE INVENTION

In accordance with the present invention, there is provided a hair extension device that allows a user to create the appearance of having additional amounts of hair without the need for: gluing hair extensions to the natural hair of the user; using supplemental hair clips; or gluing the device onto the scalp of the user. The hair extension device may include a durable filament formed into a circular or oval shape set on the user's head and encircling the head. In some embodiments, two or more hair wefts may be connected so as to form a hair flap. A hair cluster may be composed by one more hair flaps, and the hair extension device comprise the hair cluster and the filament in some embodiments.

The hair extension device is set upon the head of a user, with the portion of the filament having the hair wefts attached being positioned on the lower portion of the user's head, covering the sides and back thereof The section of the filament that is not covered with the hair wefts is situated on the crown of the user and extends down the head near the ears of the user. When the device is properly positioned, supplemental hair strands of the hair wefts extend down past the user's natural hair.

The hair of the user that is held beneath the filament is pulled forward by the user, simply by running the user's fingers through the user's natural hair and pulling the hair up and then backward over the filament. The user's natural hair therefore covers the filament and blends with the supplemental hair strands extending off of the filament.

The strength of the filament and the weight of the hair wefts allow the hair extension device to be set upon and maintained on the head of the user without the need for additional securing measures. In some embodiments, the hair extension device can be manufactured so that it does not require use of clips or glue in order to stabilize the device to the user's head.

BRIEF DESCRIPTION OF THE DRAWINGS

A complete understanding of the present invention may be obtained by reference to the accompanying drawing, when taken in conjunction with the detail description thereof and in which.

DETAILED DESCRIPTION OF THE PREFERRED EMBODIMENT

The present invention is a hair extension device that is releasably attached to the head of a user and allows the user to create the appearance of having additional hair. The extension device is designed to affix to the head of a user without the need for gluing hair extensions to the natural hair, gluing the device onto the scalp of the user or attaching the device using supplemental hair clips.

Figure 1A:
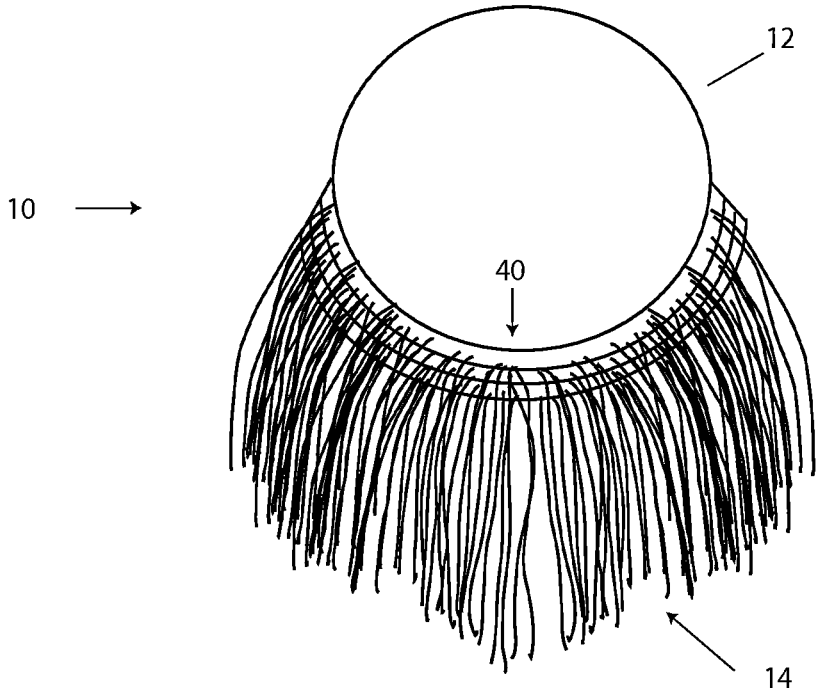
FIG. 1A is a plan view of a hair extension device according to the present invention.
Figure 1B:
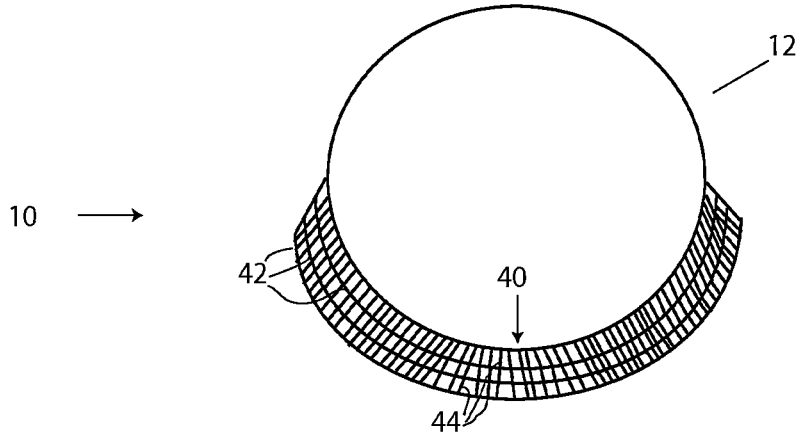
FIG. 1B is a plan view of a hair extension device shown without the hair.
Figure 2A:
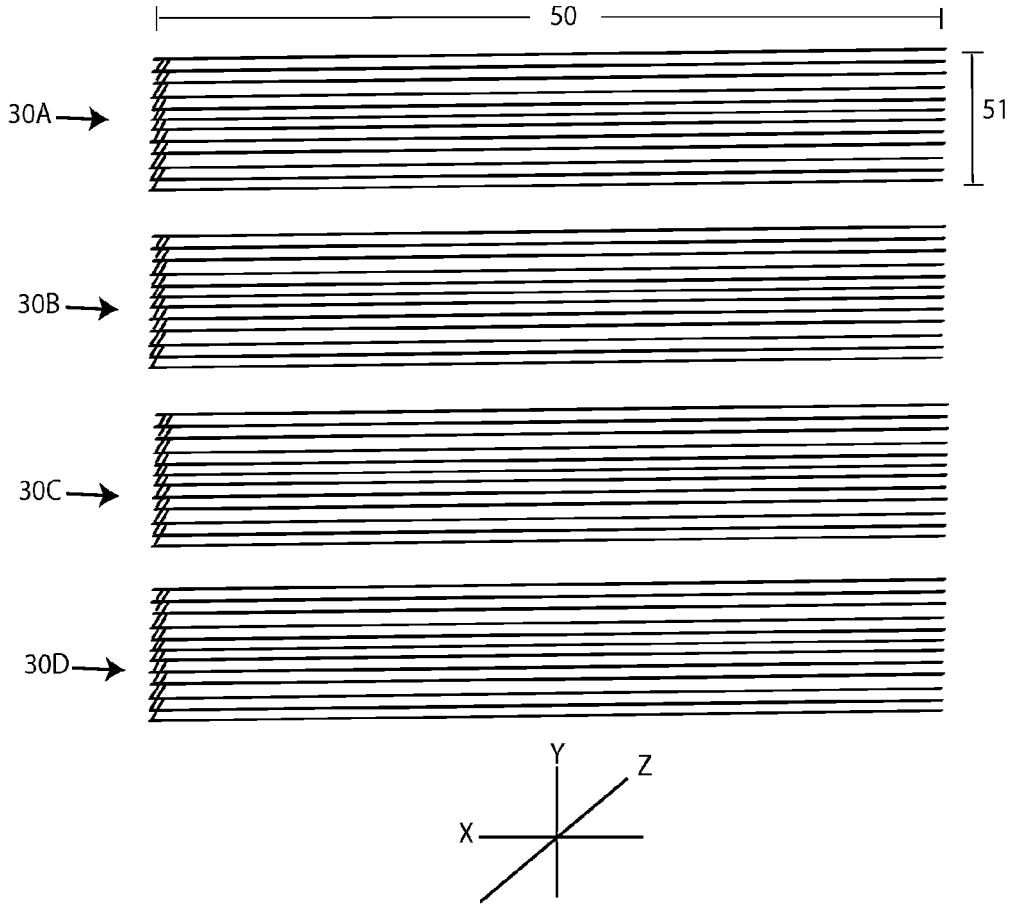
FIG. 2A is a plan view of four wefts.
Figure 2B:
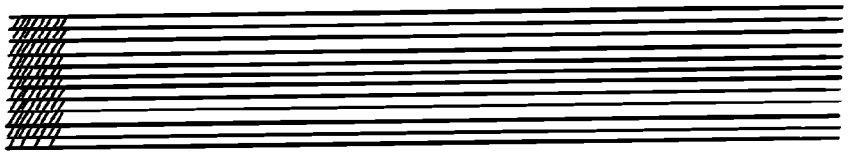
FIG. 2B is a plain view of the four wefts layered on top of one another in preparation to be sewn together using a zig-zag stitch or other stitch.
Figure 3:
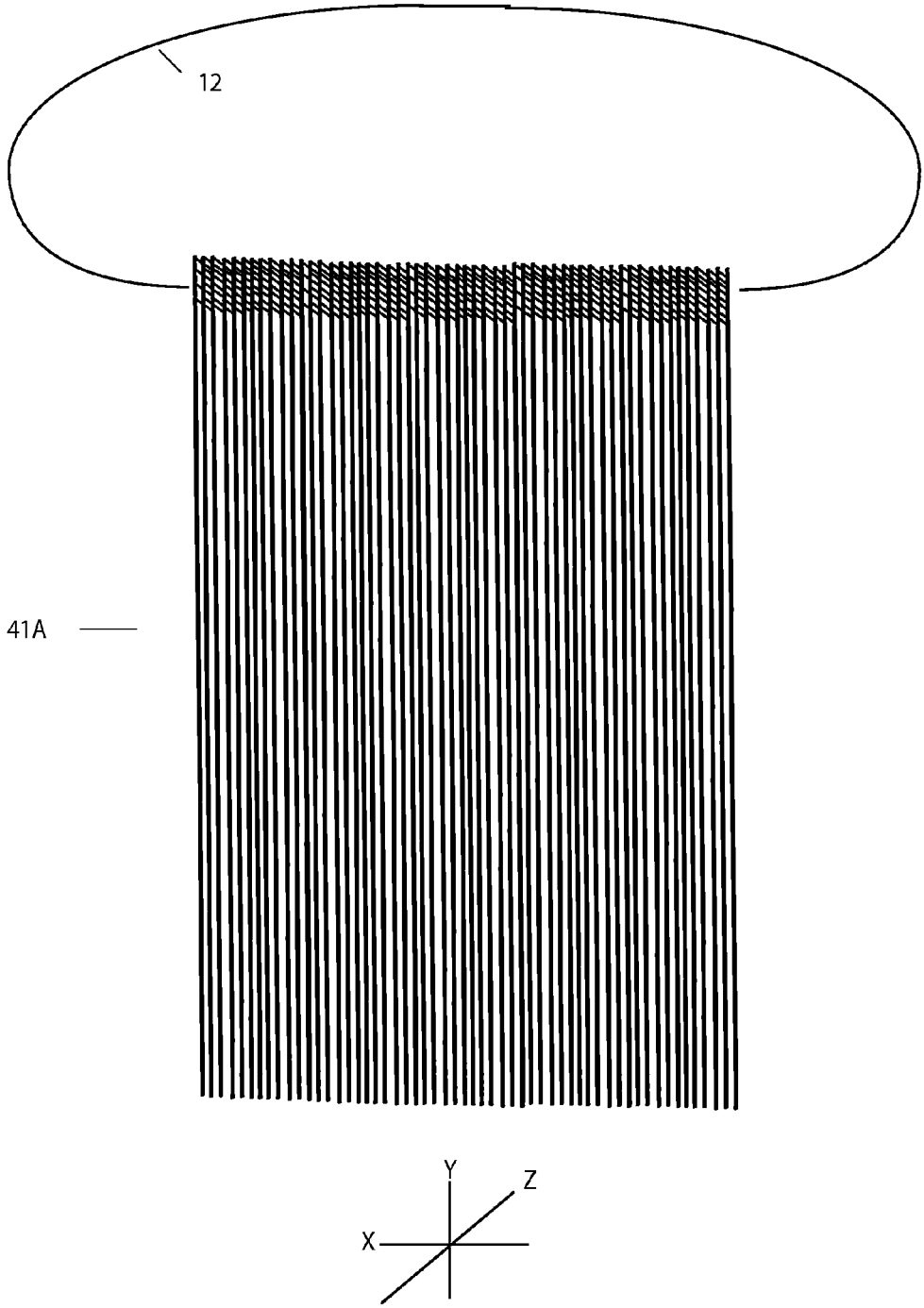
FIG. 3 is a plan view of a hair extension device illustrating the layering of the flap.
Figure 5:
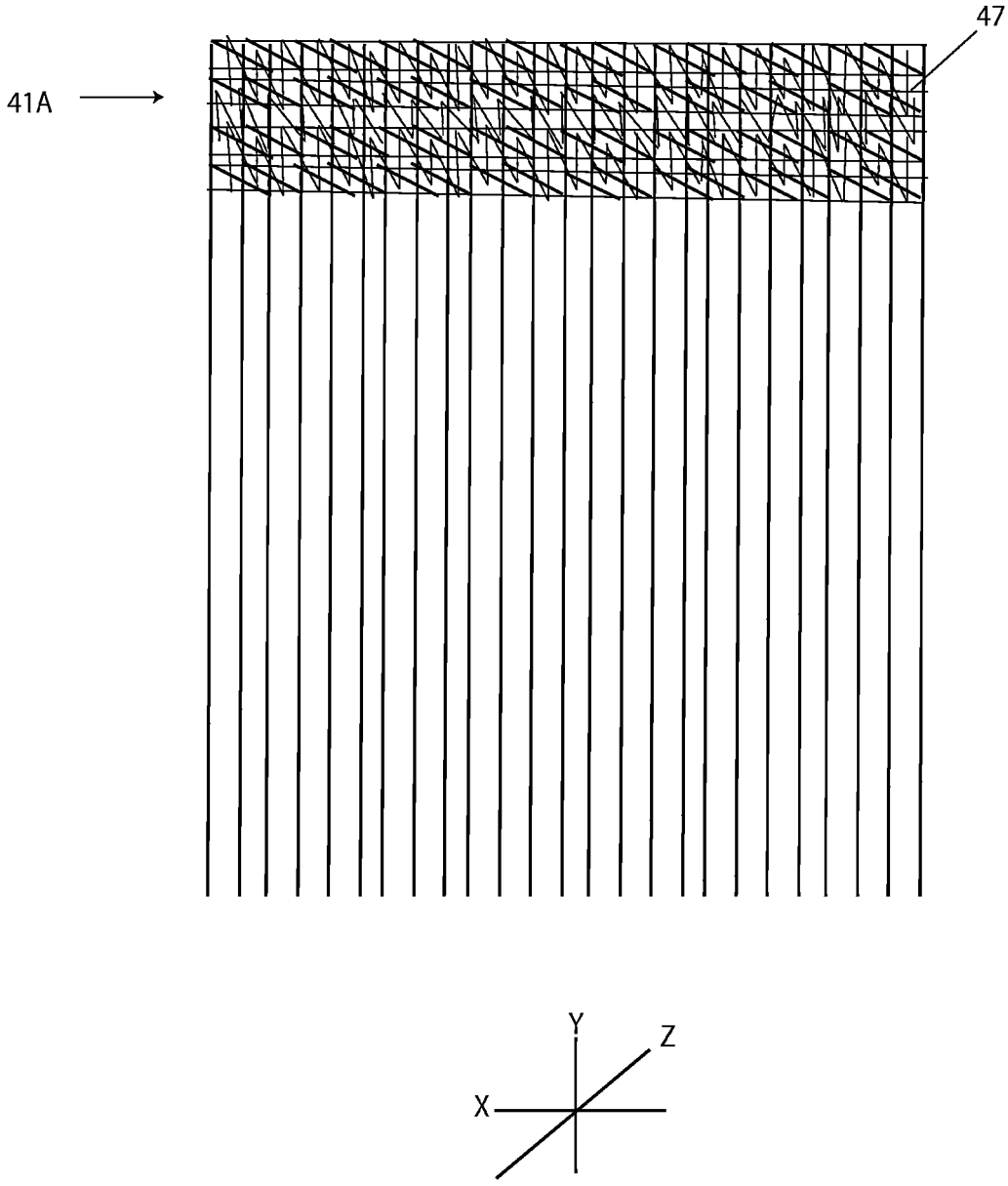
FIG. 5 shows the attachment of four wefts together.

FIGS. 1A-*and* 1B show a plan perspective view of the hair extension device 10, which includes a durable filament 12 to which a hair cluster 40 may be attached. FIG. 1A illustrates the hair strands 14. FIG. 1B shows the hair extension device with the hair strands 14 removed. FIG. 1B illustrates the bands 42 (there are three bands shown.) Seams 44 are also shown in FIG. 1B. A hair weft 30 may comprise a plurality of hair strands 14, bands 42, and seams 44. A hair cluster 40 comprises multiple hair wefts 30. Multiple hair wefts 30A-30D are illustrated in FIG. 2A. FIG. 2B illustrates the four hair wefts layered on top of one another. When the hair wefts are attached together (by for example sewing), the resulting apparatus is called a hair flap 41A, see FIG. 5. FIG. 3 illustrates the plurality of hair wefts attached to the filament 12. Although not visible because of the view, there are another four hair wefts behind hair flap 41 A in FIG. 3. See FIG. 10 which illustrates the hair extension device in a partially assembled state. Thus FIG. 3 shows a hair extension device 10, having a hair cluster 40, with two hair flaps 41A and 41B (not shown), each hair flap comprising four hair wefts. Also in all the figures, the number of hair strands shown is significantly reduced in order to improve the clarity of figures. A hair weft generally hundreds of individual hairs.

Figure 10A:
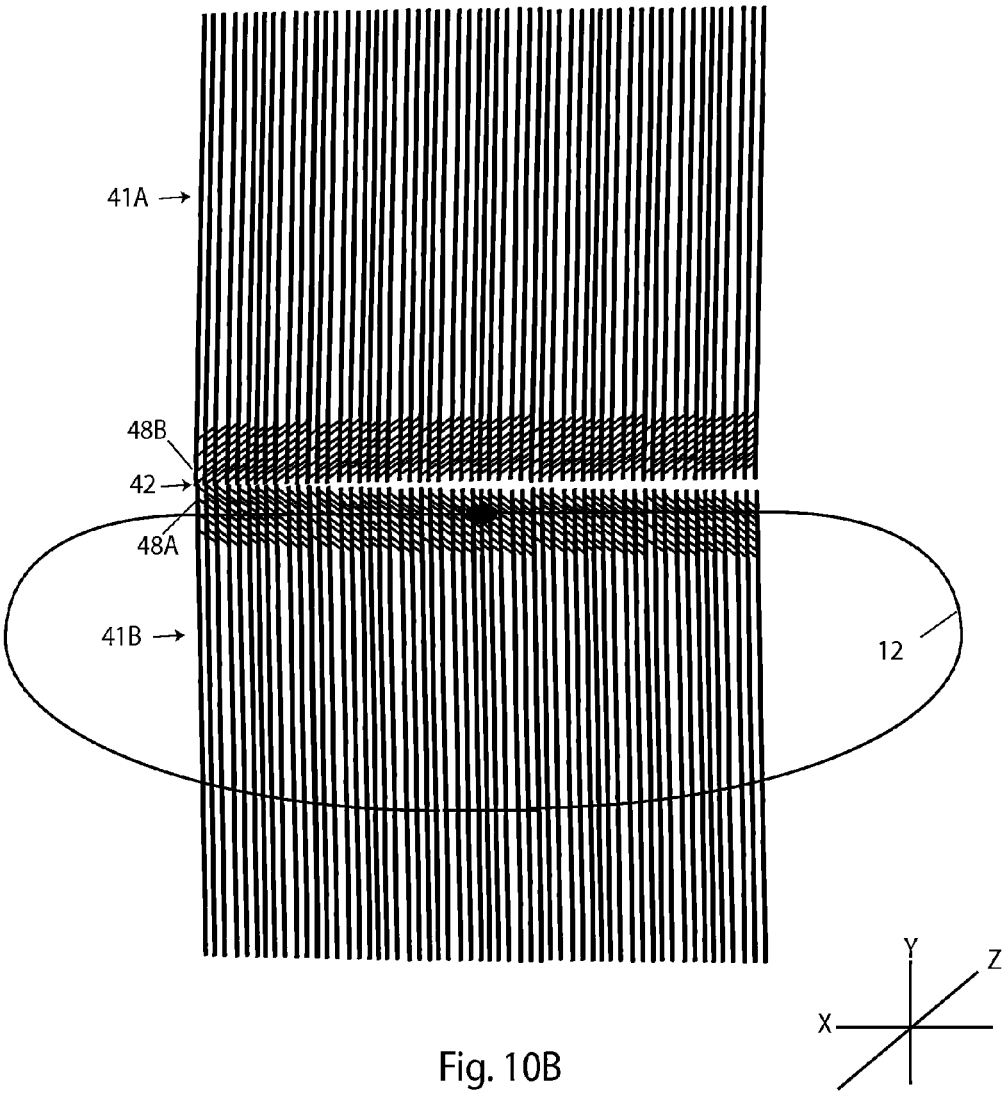
FIG. 10A is a view of a partially assembled hair extension device.
Figure 10B:
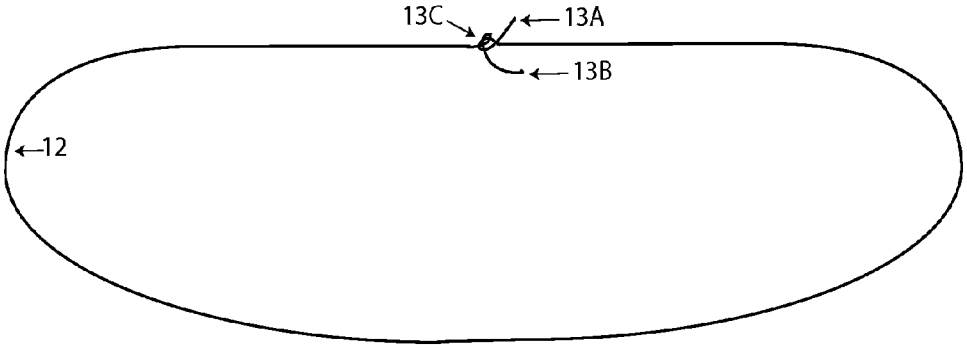
FIG. 10B is a view of an attachment mechanism of the filament.

As shown in FIGS. 1 and 3, the filament 12 may be manufactured from nylon, polyethylene, Dacron or any other type of durable material including but not limited to fishing line. In the finished product (i.e. the hair extension device 10), the filament 12 is formed into a circular or oval shape by binding, bonding, fusing, or otherwise connecting a first 13A and second ends 13B of the filament together. (See FIG. 10B showing the first 13A and second end 13B tied in a knot 13C. FIG. 10A shows the first and second ends fused by melting.) As such, the filament 12 can be set upon and encircle a user's head 13. The hair cluster is affixed along the section of the filament. This section may be approximately half of the length of the filament (or half of the circumference circular shape formed by the filament 12), but in other embodiments, the hair cluster may extend along a quarter, a third, two-thirds, or three-quarters of the filament 12. Typically a filament having a circumference of 21.5 inches to 22.5 inches is used (hut longer or shorter filaments may be used to fit individuals with bigger or smaller heads). A thin filament (preferably one having a circular or elliptical cross section) is more easily disguised in a user's hair than a flat band, ribbon, or strap. For the same reason, a transparent material may be selected for the filament 12. Also, a band or strap may not lay flat against the user's head, thereby making the hair extension device 10 less comfortable to wear, and more noticeable to observers.

As shown in FIG. 10A, a hair cluster 40 comprises at least one hair flap 41A. In some embodiments, a longer hair flap is created, folded over on itself, and fastened shut to form the hair cluster. In this case, a U shaped hair cluster is formed, the first hair flap being one leg of the U, and the second hair flap being the second leg of the U, and the middle of the flap being the arcuate portion of the U shape. In other embodiments, two or more hair flaps 41A and 41B are joined together to form the hair cluster 40. In this case, a U shaped hair cluster is formed, the first hair flap being one leg of the U, and the second hair flap being the second leg of the U. A hair flap 41A comprises a plurality of hair wefts 30A-30D fastened together as described below. FIG. 10A also shows first hair flap 41A partially fastened to flap 41B. Element 42 shows the point of partial attachment.

A hair weft 30 is made from a plurality of supplemental, natural, or artificial hair strands 14 that are bound together to create the weft 30. FIG. 2A shows that the hair weft 30 has a length 50 (X-axis) and a width 51 (Y-axis). The weft has a depth as well which would extend along the Z-axis. The hair strands 14 are arranged in a somewhat parallel manner (along the length) and bound together near the top of the strands to form the weft. The binding material, the band 42, may be formed by sewing a plurality of seams 44. Generally, the band 42 extends along a direction orthogonal to the seams 44. The weft may comprise a single row of strands, one hair strand deep, or the weft may comprise a depth containing many hair strands 14. For example, some wefts can contain 10, 20, 50, or a 100 hairs in the depth direction. The width of the weft 30 may vary, but a width between seven to twelve inches is useful for the hair extension device 10.

Figure 4A:
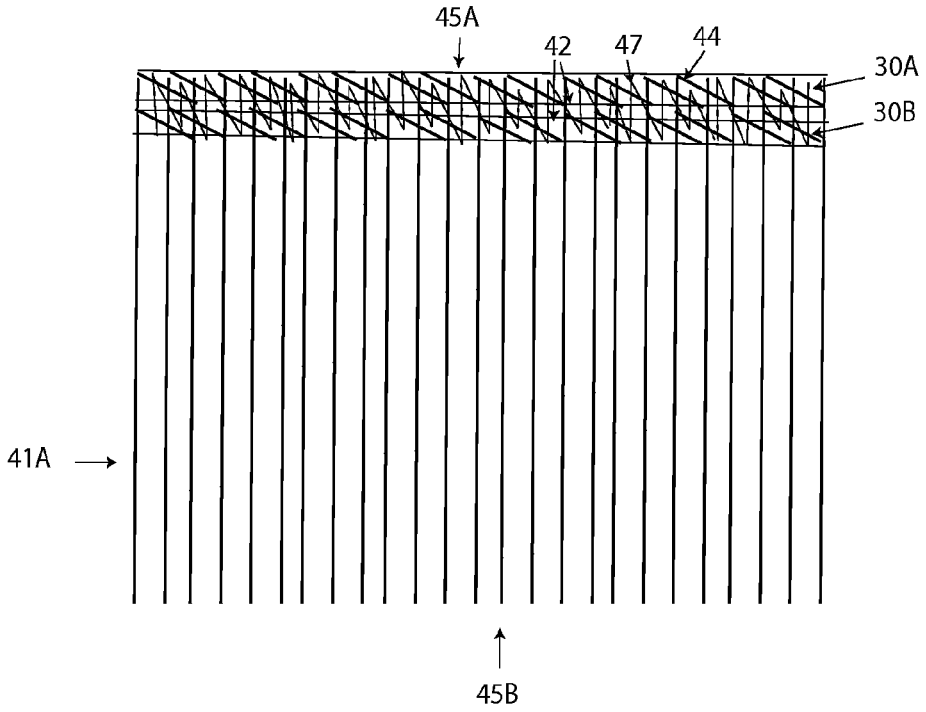
FIGS. 4A and 4B show the attachment of a first weft to a second weft.
Figure 4B:
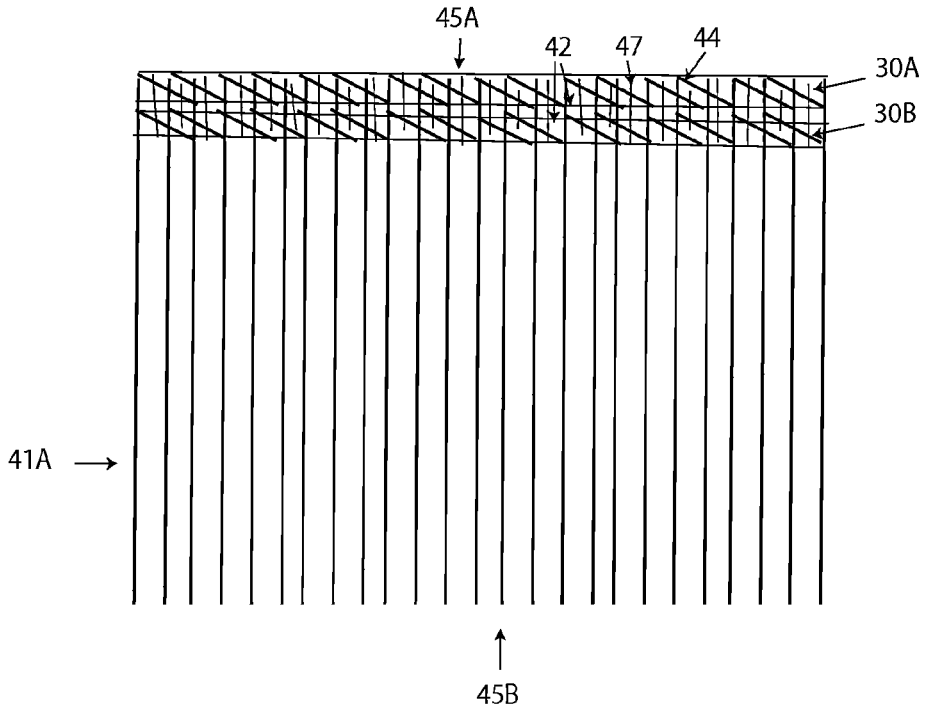
Figure 4C:
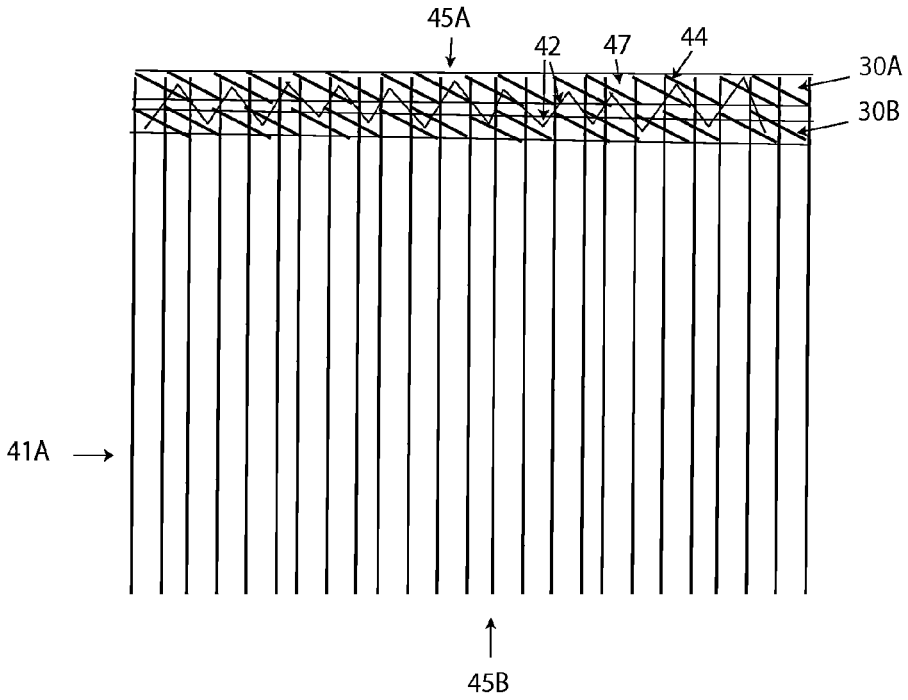
FIGS. 4C-4D show alternate embodiments of the zig-zag stitch of FIG. 4A.
Figure 4D:
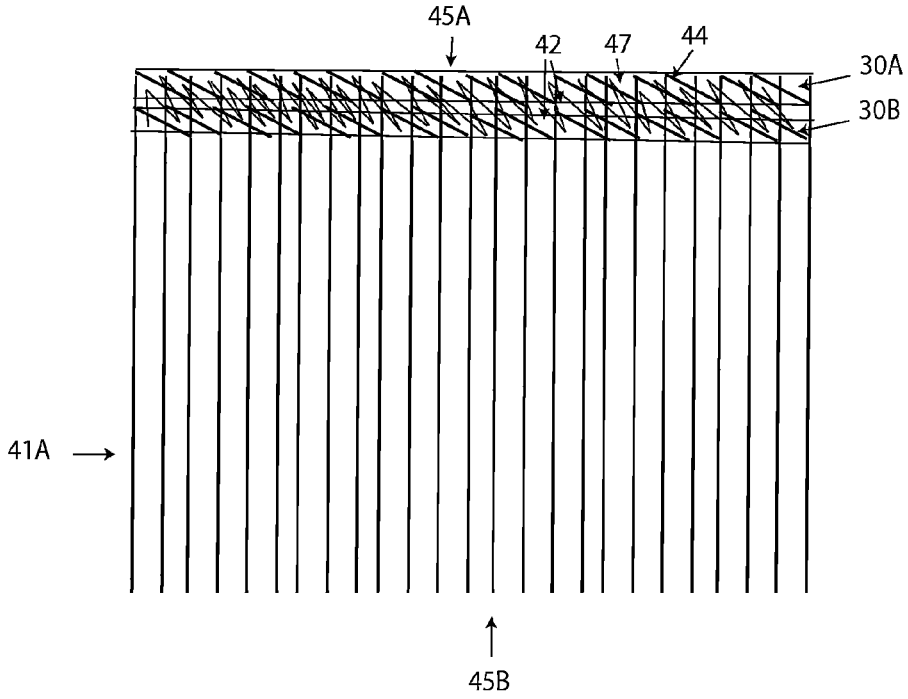

In one embodiment, the hair extension device 10 may comprise a plurality of hair wefts, each hair weft being layered one on top of the other to form a staircase profile. The hair extension device 10 may comprise one, two, or more hair flaps. (Two are shown in FIG. 10A). Looking at FIG. 4A and 4C, a flap 41 with two hair wefts is shown. The flap 41A has a top end 45A and bottom end 45B. A first hair weft 40A may be sewn to a second hair weft 40B. The bands 42 and seems 44 are also shown. The first 41A and second hair weft 41B may be attached via a zig-zag stitch 44. For the purposes of illustration and explanation, the path a needle would make in forming the zig-zag stitch is shown. The thread applied to the substrate (in this case the band 42), would rest upon opposite sides of the substrate each time the needle passed through the substrate. FIG. 4B (and also FIG. 7) shows what this would look like (all other figures show the complete path of the needle, with the understanding that not all the thread would necessary be visible at all angles.) The pattern of thread placed on the substrate via stitch 47 is a zig-zag, meaning that the thread passes through alternating seams 44 of the first weft and the second weft as the needle is passed from the left of the weft to the right of the weft. Various zig-zag patterns can be formed (FIG. 4A shows a gradual zig-zag stitch, FIG. 4C shows an 'M' zig-zag stitch, FIG. 4D shows a retreating zig-zag stitch) and a given embodiment need not necessarily stitch every seam. More stitches is generally more timing consuming to make and requires more thread which may be stronger against pulling and make the hair extension device more durable. The choice in thread may play a factor in determining what percentage of seams 44 are skipped when sewing the wefts together. Other embodiments of the invention may use a different stitch such as an overhand stitch, wherein the stitching technique forms a plurality of circles, which allows each first and second hair flap to rotate towards or away from each other. However, experimentation with many different types of stitching has revealed that the zig-zag stitch 47 is the strongest stitch for forming the hair extension device 10.

Figure 6A:
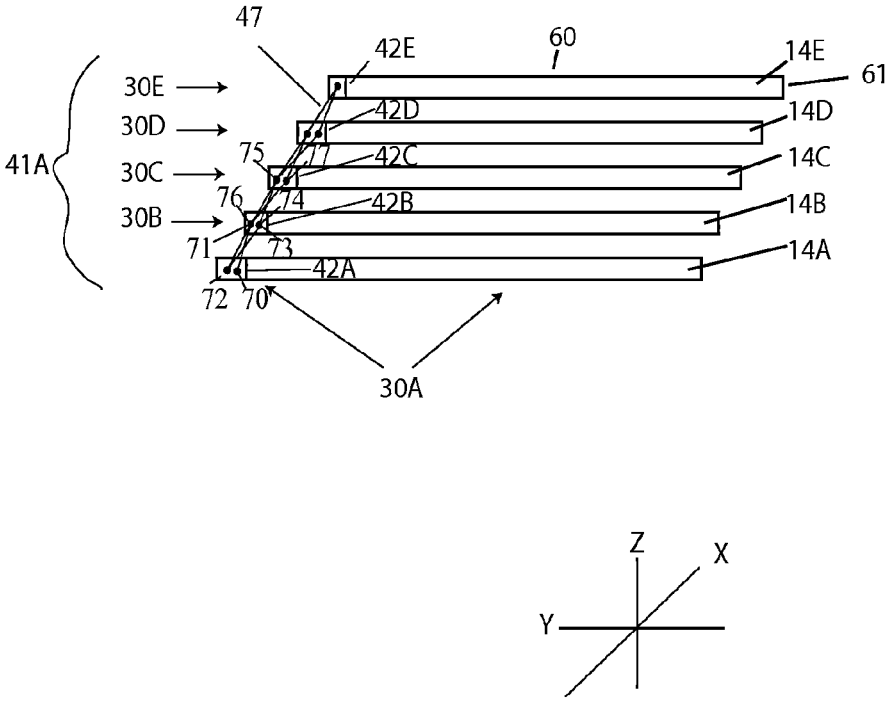
FIG. 6A is a cross section view of the wefts and the attachment of the wefts together via a layered, non-overlapping staircase approach utilizing a zig-zag stitch.
Figure 6B:
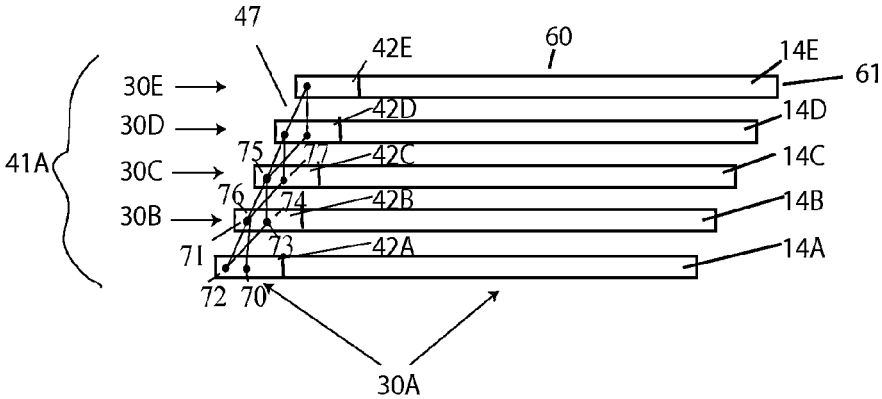
FIG. 6B is a cross section view of the wefts and the attachment of the wefts together via a layered, overlapping staircase approach utilizing a zig-zag stitch.
Figure 6B:
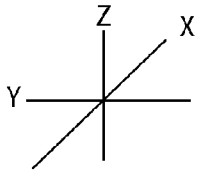

The embodiment shown in FIG. 4 shows how one would attach the first 30A and second hair weft 30B. FIG. 4 has a first piece (i.e. the first weft 30A) of the first flap 41A, and a second piece (i.e. the second weft 30B) of the first flap 41A. To form the entire flap, multiple hair wefts (at least two, but as many as ten or more) are connected to form the flap. Optimization and experimentation with differing configurations have revealed that four to six wefts are an optimum number of hair wefts to use per flap, because less wefts do not provide a sufficient volume of hair to add to the user's natural hair, and more than six wefts can be too heavy to wear. In a preferred embodiment, a third and fourth hair wefts is layered on top of one another. See FIG. 5. Layering allows for additional wefts of hair to be attached to the flap without linearly increasing the thickness of the flap as a function of the number of wefts. If layering is not used in the manufacturing process, each band would be attached directly to the band beneath it. In other words, the bands would be attached "back-to-back." Although this assembly technique provides a durable final product and is easier to manufacture than the layering technique, it has a disadvantage . . . namely the plurality of stacked bands (the bands which are attached back-to-back) increase the overall thickness of the flap as function of the number of wefts (bands) in the flap. Width, and depth of a flap are illustrated in FIG. 6A-6B. Notice, the axis have been shifted, since this view shows a cross-section across the X-axis.

Figure 7A:
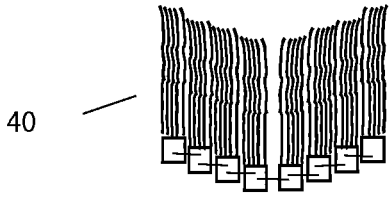
FIGS. 7A-7D show a cross section of the hair cluster created without using layering.
Figure 7B:
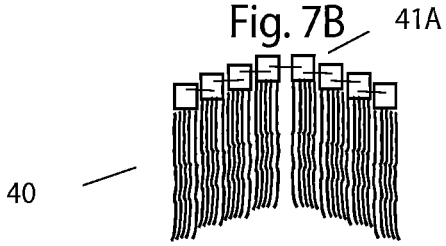
Figure 7C:
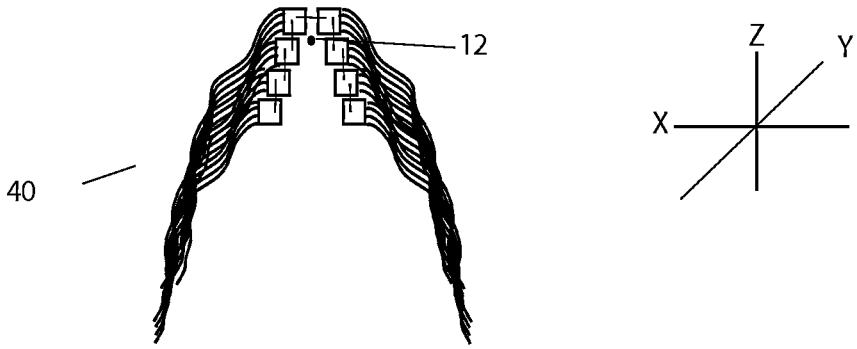
Figure 7D:
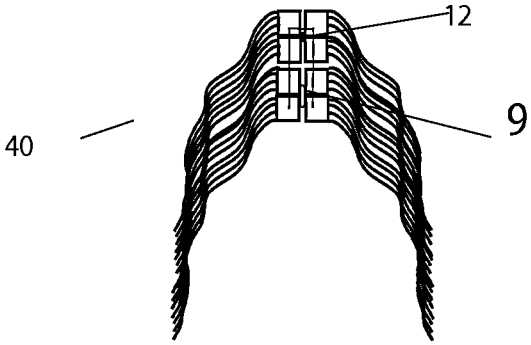
Figure 9A:
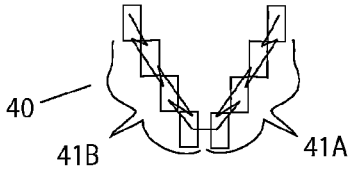
Figure 9B:
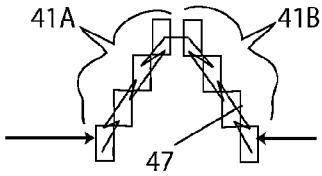
Figure 9B:
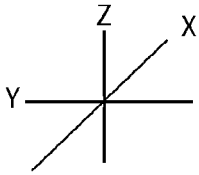
Figure 9C:
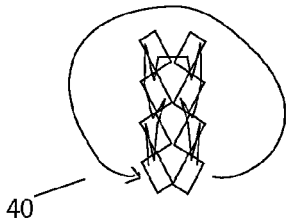

An alternate configuration of the invention may be made by sewing together a plurality of back to back wefts. This pad linking technique (as contrasted with the staircase technique discussed below, which uses layering) may include the following steps. For example, four bands can be attached back-to-back to form a first pad. A second pad can be formed by attaching four more bands back-to-back. The second pad can be attached to the first pad "length-to-length" or by layering. In the length-to-length configuration, the first pad and second pad are lined up along their lengths. Then they are sewn together with a zig-zag or overhand stitch (other stitches may be used). The flap may be created by connecting three more pads together, creating a series of pads attached length to-length. The resulting flap would have 5 pads, each pad having wefts bands (20 wefts total.) Depending on the look desired, one might create a staggered flap, by reducing or increasing the thickness of the flap along the width of the flap (see FIG. 10) by attaching more or less bands to the pad. The length-to-length assembly technique may even be used for a pad having a thickness of one band. This embodiment is shown in FIG. 7D (discussed below). While the single layer length-length fastening technique creates a low profile design, the structure fragility of this design makes it less desirable (in some configurations) than the staircase technique next to be described.

Referring to FIG. 6A-6B and FIGS. 8A-8H and 9A-9H, the staircase layering technique is illustrated both using a non-overlapping technique (FIG. 6A, FIGS. 8A-8D, FIGS. 9A-9D) and overlapping technique (FIG. 6B, FIGS. 8E-8H, FIGS. 9E-9H). The difference between the figures being that there is no overlapping of the bands in one configuration and a partial overlapping of the bands in the other configuration. Either way, FIG. 6A-6B illustrate a schematic cross section of an embodiment of the invention illustrating how the layering and zig-zag stitch would look across the X-axis. The weft 30A is shown as a box comprising a band 42A and hair 14A. Five bands 42A-42E and 5 hair boxes 14A-14E are shown. Actual hair strands (not shown) would flow from points 60 and 61. FIGS. 6A-6B illustrate placing a portion of the second weft 30B on top (or on bottom) of the first weft 30A (this is called "layering".) The portion may be 5%-80% of the band 42A in an overlapping configuration (FIG. 6B). If the bands (42A and 42B) are the same width (X-axis), the amount of the first band 42A covered by the second band 42B could be exactly the same as the amount of the second band covering the first band. Increasing the percentage of the second band 42B which overlaps the first band 42A increases the strength of the flap, while at the same time increasing the thickness of the flap 41A. (A thicker flap is more easy to identify in a user's hair than a thinner flap. Since it is preferable to create a hair extension device which is hard for non-users to notice, thinner flaps are preferred.) And so, while providing some level of overlap may increase the strength of the hair extension device, one can create a flatter, thinner hair extension device 10 by not overlapping the bands (the FIG. 6A, FIGS. 8A-8D, and FIGS. 9A-9D embodiment.) About 30% overlap is shown in FIG. 6B, and FIGS. 8E-8H, and FIGS. 9E-9H.

Typically a first weft will be attached to a second weft, before a third weft is attached to the first second weft. As a result, FIGS. 6A-6B in effect shows the first two stitches of a series of stitches which joins the wefts together. An exemplary sequence of the zig-zag stitch may begin at attachment point 70, move to point 71, then to 72, then to 73. The needle and thread would then progress along the hidden X-axis (the width of the weft) moving from the leftmost part of the weft (with respect to FIG. 5) to the rightmost part of the weft. (Naturally, the reverse direction would work as well.) Once completed, the machine sewing the hair extension device (or it can be handmade) will reverse direction and move in the negative X direction (the machine's needle could also be moved to attachment point 74.) In the embodiment of FIG. 6A-6B, attachment point 74 is in the same location as point 73. The needle then moves to points 75, 76, and 77. The pattern would repeat down the width of the weft (the positive X direction). This process is repeated for all the wefts. The resulting cross section would resemble the schematic shown in FIG. 6A-6B.

The material used in the stitch may be thread, hair, fishing line, or other thin material useful sewing. By passing a needle in a zig-zag pattern, the resulting flap has increased durability, as compared with using a back stitch, overhand stitch, running stitch, or other stitch. The reason for this increased durability is that the zig-zag stitch protects against multi-direction pulling better than a running stitch or back stitch. In the back-to-back technique, a zig-zag stitch is generally not used since a first running stitch can be used to fasten the top sections of the bands to each other, and a second running stitch could be used to fasten the bottom section of the bands to the each other (a single or triple running stitch configuration can also be used).

Figure 8A:
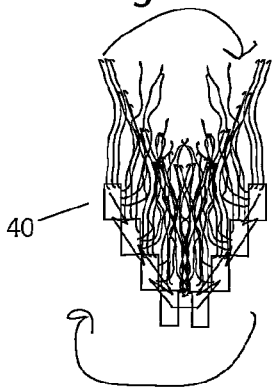
FIGS. 8A-8D & 9A-9D show a cross section of the hair cluster created using non-overlapping layering technology.
Figure 8B:
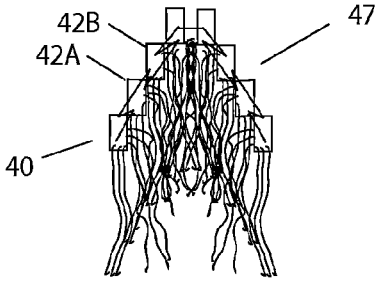
Figure 8C:
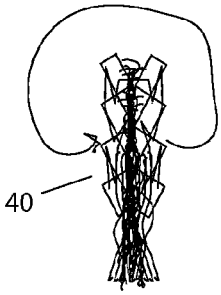
Figure 8D:
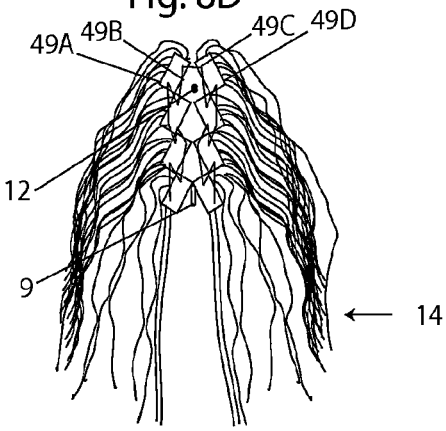
Figure 9D:
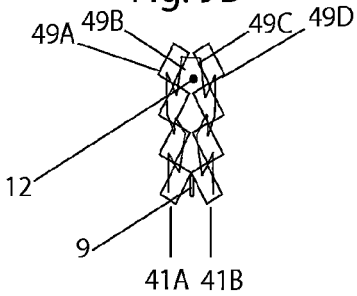
Figure 8E:
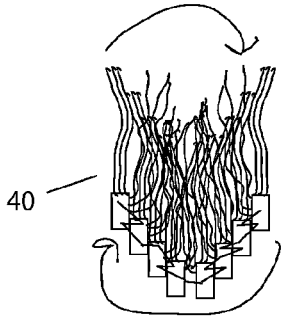
FIGS. 8E-8H & 9E-9H show a cross section of the hair cluster created using overlapping layering technology.
Figure 9E:
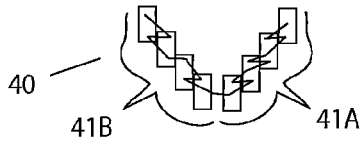
Figure 8F:
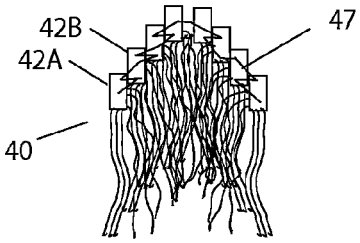
Figure 9F:
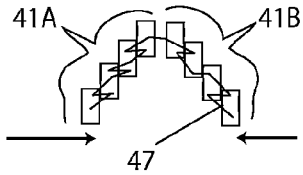
Figure 9F:
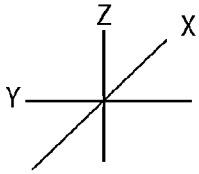
Figure 8G:
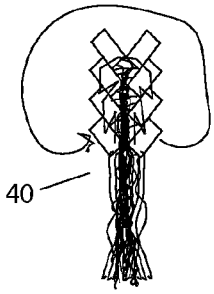
Figure 9G:
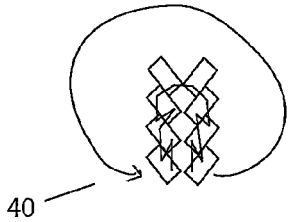
Figure 8H:
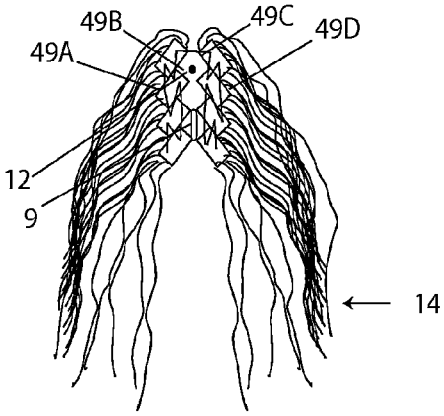
Figure 9H:
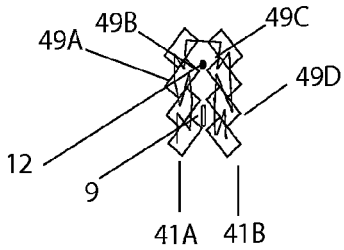

Referring again to FIGS. 6A-6B, once the second band 42B is attached to the first band 30A via the zig-zag stitch technique 47, a third band 42C may be attached to the second band 42B using the same zig-zag stitch 47. FIG. 6A and 6B show the three bands separated by a distance to show the connection technique, while FIGS. 1A and 8D show the final configuration when the thread of the stitch is pulled tight. A fourth band 30D may be attached to the third band 30C as well. This process may be repeated until the amount of strands of hair is high enough for the hair extension device (typically 3-6 wefts are attached to each flap in this manner). The more fastened wefts, the more hair which is added. Hair clusters having more hair create the appearance of fuller hair, but are more expensive since they require more hair wefts, and they also increase the mass of the hair extension device 10.

FIGS. 7-9 show the construction of a hair extension device 10. FIGS. 7A-7D illustrate a nonlayered construction embodiment wherein the top of each band is attached to the bottom of the band above it. FIGS. 7A and 7B show views of the hair cluster 40. FIG. 7C shows the flaps 41A and 41B being brought together to sandwich the filament 12 (it's shown in a cross-section). FIG. 7D shows the flaps being closed and sealed with glue 9. FIGS. 8 and 9 show the layered staircase construction with the first flap 41A being attached to the second flap 41B via the zig-zag stitch 47. FIG. 8 shows the same view as FIG. 9, except the hair 14 is removed from FIG. 9. As shown in FIGS. 9C and 9D, when the bands 42A, 42B are being stitched together, the stitching is performed on the side opposite the hair 14. During the manufacturing process, the sides having the stitching are placed on the inside 49B and 49C of the cluster 40 when the flaps are brought together. So in one embodiment, the manufacturer may stitch all the wefts together by placing the wefts on a surface (e.g. a table, platform, work bench, etc) to form a first flap. The manufacturer would create a second flap in the same way. Then the manufacturer could attach the first flap to the second flap. In performing this attachment, the manufacturer would place the sides having the stitching 47, seams 44, and bands on the inside of the hair cluster 40 so that the bands and seams 44 are hidden in the final product. Since the stitching 47 is often performed on the top side (wherein the manufacturer can look down at the seams 44, bands, and stitching 47), the manufacturer may turn the cluster inside out (or flip one of the flaps over) so that the portions having the seams 44, bands, and stitching 47 face the inside of the cluster. The inversion process is illustrated with the arrows in FIGS. 9A-9D.

Figure 11A:
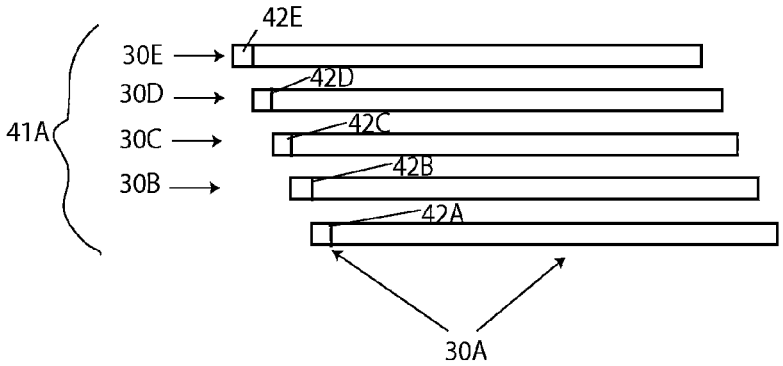
FIG. 11A is a cross section of the wefts and the attachment of the wefts together via a layered reverse staircase approach utilizing a zig-zag stitch.
Figure 11B:
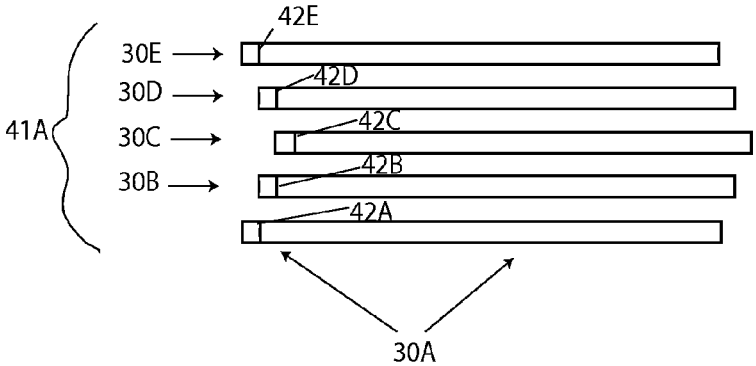
FIG. 11B is a cross section of the wefts and the attachment of the wefts together via a layered pyramid approach utilizing a zig-zag stitch.
Figure 11B:
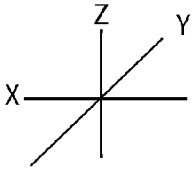
Figure 11C:
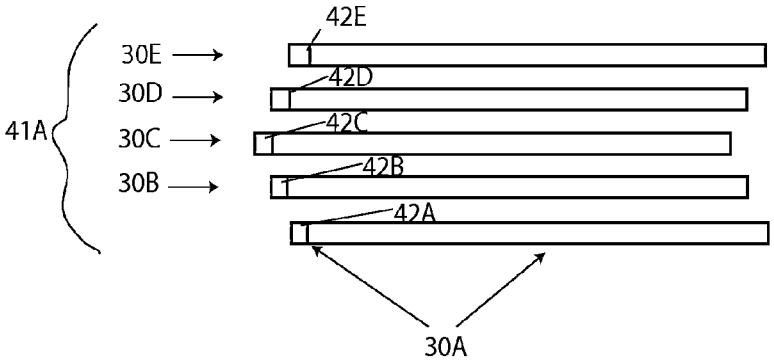
FIG. 11C is a cross section of the wefts and the attachment of the wefts together via a reverse pyramid approach utilizing a zig-zag stitch.
Figure 11D:
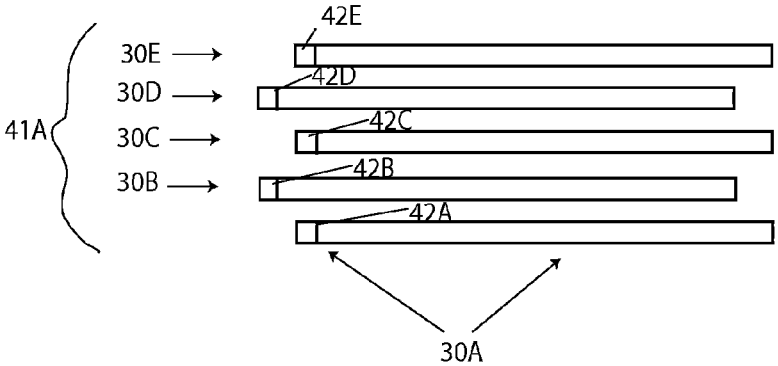
FIG. 11D is a cross section of the wefts and the attachment of the wefts together via a layered wave approach utilizing a zig-zag stitch.

As described above, layering may be used to create the staircased flap, but it may also be used to make the reverse staircase (FIG. 11A), pyramid flap (FIG. 11B), reverse pyramid (FIG. 11C), wave (FIG. 11D), or hybrids thereof. In the staircase embodiment (FIGS. 6A-6B), the top most weft (30E) is also the outermost band (i.e. the most distal to the filament). The X+1 weft (30D) is attached behind the X weft (30E) and offset downwardly. The X+2 (30C) weft is attached behind the X+1 weft, and offset downwardly from the X+1 weft. And so on. The X+N weft (N being the number of the weft) is the lowermost weft, and the one most proximal to the filament. The reverse staircase (FIG. 11A) is the reverse of the staircase, so the X weft is most proximal to the filament, and the X+1 weft is placed on top of the X weft. The pyramid configuration has the most distal weft being the X+N/2 weft–the X+N/2+1 wefts are both placed beneath the X+N/2 weft. The reverse pyramid configuration has the most proximal weft being the X+N/2 weft–the X+N/2+1 wefts are both placed on top of the X+N/2 weft. The wave configuration has wefts which are placed on top of one another for A wefts (A being the height of the amplitude of the wave) and once the $A^{th}$ weft is reached the A+1 weft is placed below the $A^{th}$ weft until the $2A^{th}$ weft is reached. At that point, the $2A^{th}$+1 weft is placed on top of the 2A weft. A reverse wave may also be created in a similar manner. A hybrid configuration may also be used which combines any of these techniques. One reason for building the flap in one configuration versus another is to allow from the development of hair piece which more closely model the target users hair. Because real users (i.e. everyday people) do not always evenly flowing hair, adding a hair extension device easier to notice.

By making a hair extension device which models the imperfections of the wearer, the hair extension device can more readily blend into the wearer's natural hair. Similarly, one may choose the colors of the wefts or even the individual hair (or even use the eventual wearers own hair) based on the color of the wearer. If the wearer's hair has multiple colors, blond and gray for example, then a hair extension device having a similar frequency of blond and gray hairs may be desirable.

Referring to FIG. 10A, when the flap 41A is ultimately constructed (using for example the staircase technique), it may be attached to a second flap 41B using the zig-zag stich 47. (Alternatively, the flap itself may be folded in half to form two parts.) The attachment of the top portion 48A of the first flap to the top portion 48B of the second flap may be performed while the flaps are being built (bands are being layered on each other) or after the flaps are completed. After the two flaps are created and attached together, the filament 12 may be placed along the inner portions 49B and 49C of the two flaps 41A and 41B (See FIG. 9D). (The inner portions 49B and 49C of the flaps are the portions which make contact with each other and the filament, while the outer portions 49A and 49D do not. Moreover, in the finished product, the inner portions 49B and 49C are not visible, not exposed to the environment, or does not come into contact with the wearer's natural hair when the hair extension device 10 is being worn, while the outer portions 49A and 49D are visible, are exposed to the environment, or do come into contact with the wearer's natural hair when the hair extension device is being worn.) In some embodiments, the filament 12 may be positioned so that it rests against the zig-zag stitch connecting the flaps 41A and 41B. The filament 12 may also be glued 9 to the inner sides of the flaps. Either way, the flaps sandwich the filament (which is in the middle, between the two flaps). One benefit of this construction is the hair extension device is that the hair may be constructed so that it is reversible. In some constructions, the hair extension device has a plane of symmetry extending along the Y-Z plane, and the X-Y plane. Since the hair extension device has two planes of symmetry it is also reversible, that is a user can flip the hair extension device over (180°) rotation along Y-axis and where the device the same way as he or she would in the non rotated design. Of course a finished product of this configuration might not be purely symmetric because of minor tolerances in the hair wefts or their attachment to the hair extension device. Nonetheless, generally or largely, a hair extension device of this configuration will have two planes of symmetry.

As shown in FIG. 10B, the ends 13A and 13B of the filament 12 may be sealed together by heat, glue, or may be tied with a knot 13C. In some embodiments, the point at which the ends are fastened (the filament attachment point) may be placed within the flaps (i.e. touching the inner portions of the flaps), so the filament attachment point is not visible to the user.

In many embodiments, the width of the flaps is governed by the width of the band of the weft, but two or more bands could be connected width to width to make a wider flap. This may be useful to combine wefts of different colors or configurations (straight, wavy, etc).

Figure 12:
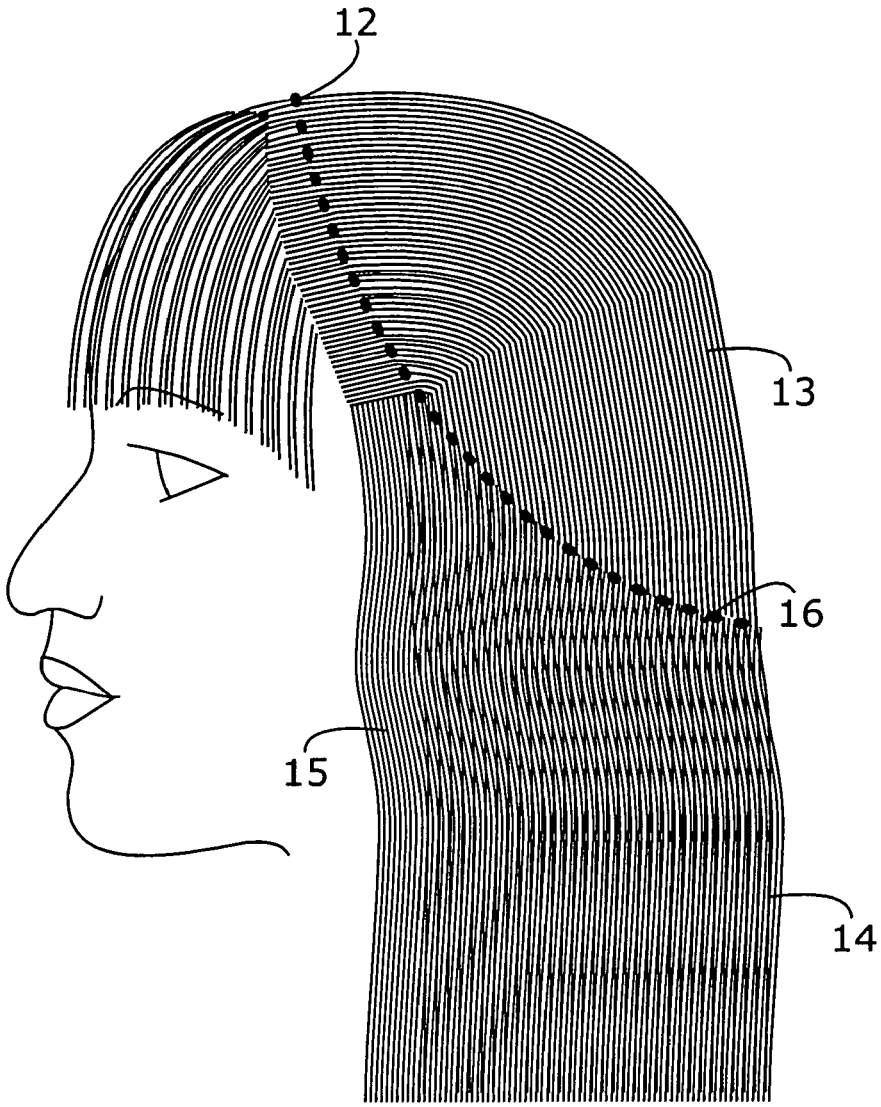
FIG. 12 illustrates a user wearing the hair extension device.

When being worn, see FIG. 12, the filament 12 is set on top of the user's natural hair 15 and encircles the user's head 13. The circular filament 12 is placed on the head 13 such that the section of the filament 12 and hair cluster 40 attached are positioned on the lower portion of the head 13. The remainder of the filament 12 is positioned on the crown of the head 13. The hair strands 14 of the hair wefts 30 extend down past the user's natural hair 15 along the back and sides of the user. In other words, when the hair extension device is being worn, a first portion of the filament (the portion which does not have the hair cluster 40 attached to it) is in contact with the crown or top of the user's head, while a second portion of the filament (the portion which does have the hair cluster 40 attached to it) is in contact with the bottom of the user's head (near the back of the user's neck).

The natural hair 15 of the user that is held beneath the filament 12 is pulled up and over the filament 12 so that the filament 12 cannot be seen by an onlooker (essentially becomes invisible) because the view of the filament is obstructed by the user's natural hair. The user generally simply runs the user's fingers through the user's natural hair 15 and pulls the hair up and then backward over the filament 12. The user's natural hair 15 therefore covers the filament 12 and blends with the supplemental hair strands 14 extending off of the filament 12.

The strength and rigidity of the filament 12 and the weight of the hair wefts 30 allow the hair extension device 10 to be set upon and maintained on the head 13 of the user without the need for any additional securing measures. In some embodiments of the invention, the hair extension device consists of a filament and a hair cluster. While a user could add an additional fastening device such as glue, a tie, or a clip, essentially the hair extension device would consist of just the filament and the hair cluster. In these embodiments, the filament and hair cluster are structured so that these fastening devices would be necessary to hold the hair extension device in place. In other embodiments, additional components may be added to the hair extension device so that the hair extension device comprises the filament, hair cluster, and additional components. Additional components may include fastening devices, headbands, comb, bowties, flowers, etc.

Figure 13A:
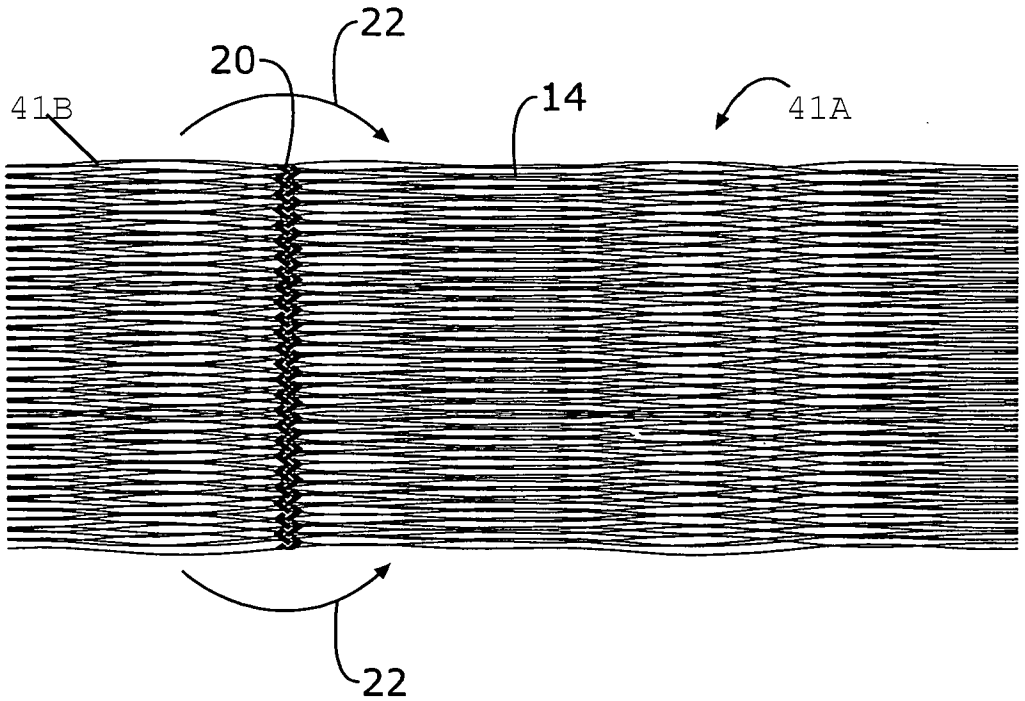
FIGS. 13A-13C illustrate the assembly of a hair extension device.
Figure 13B:
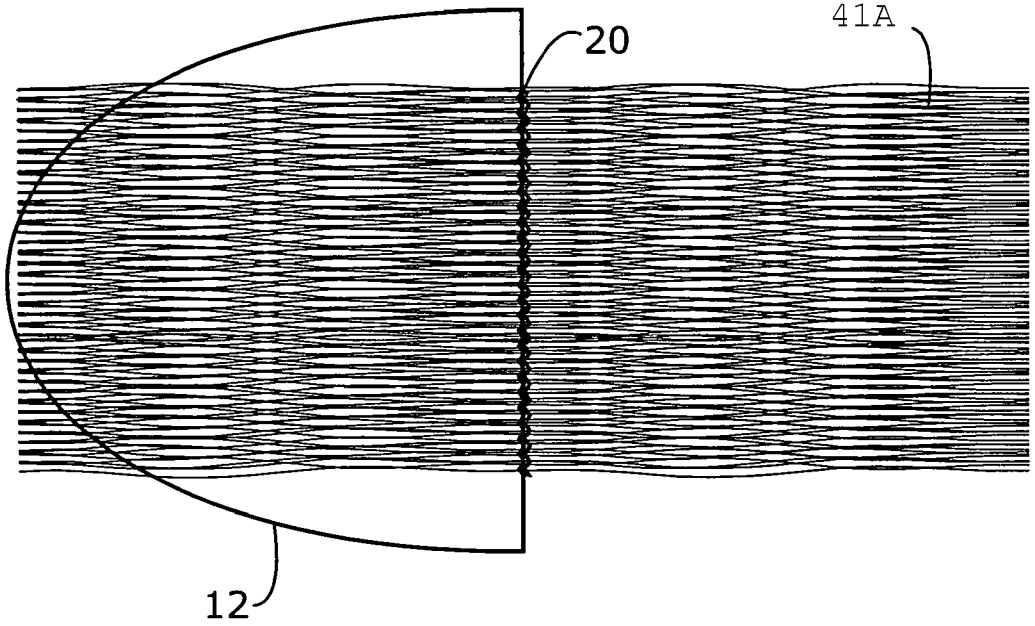
Figure 13C:
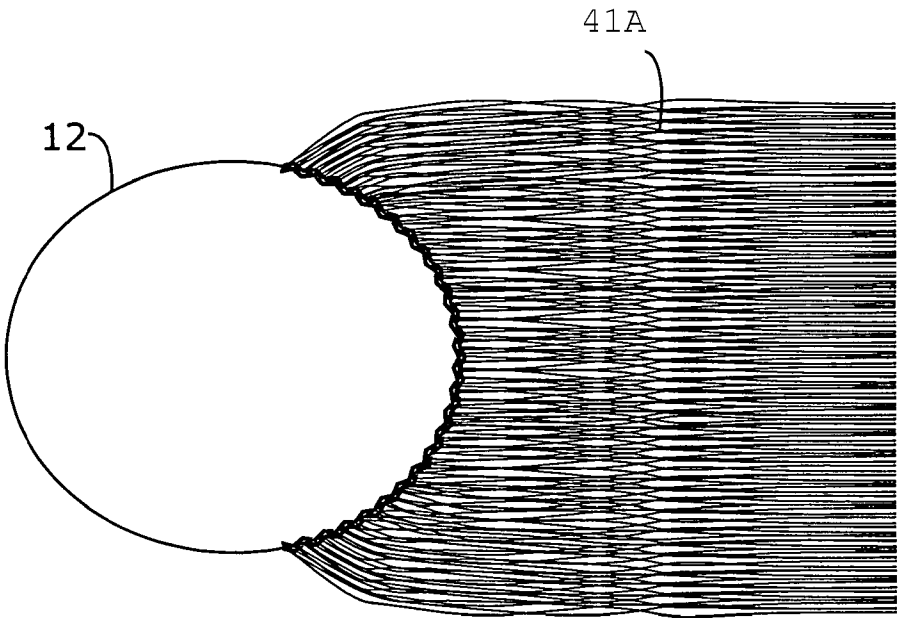

FIGS. 13A-13C illustrate similar views which are shown in FIGS. 10A and 10B. As discussed previously, a plurality of wefts can be sewn together with a zig-zag stitch using a thread 20 to form a flap 41. As shown in FIGS. 13A-13C, the flaps 41A and 41B are then folded over the filament 12. FIG. 3B shows that filament 12 is laid on top of the flap 41A. The flaps 41A and 41B are then folded over the filament 12, sandwiching filament 12. The flaps may be glued (9, FIG. 9D) or otherwise fastened shut. The final device 10 has the arcuate portion of filament 12 attached to flaps 41A and 41B, as shown in FIG. 3C.

Figure 14A:
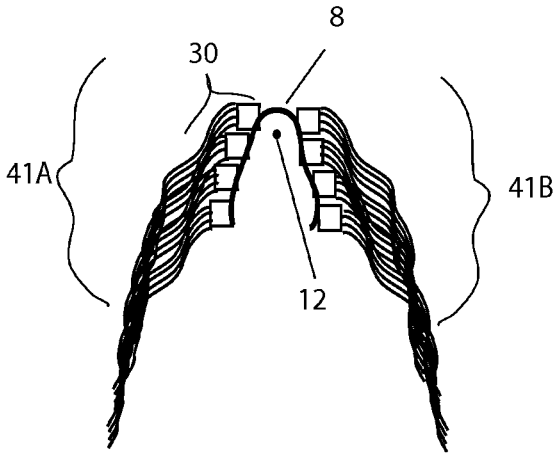
FIGS. 14A-B is a cross section view of a configuration of the invention wherein the wefts are secured to lace or a ribbon.
Figure 14B:
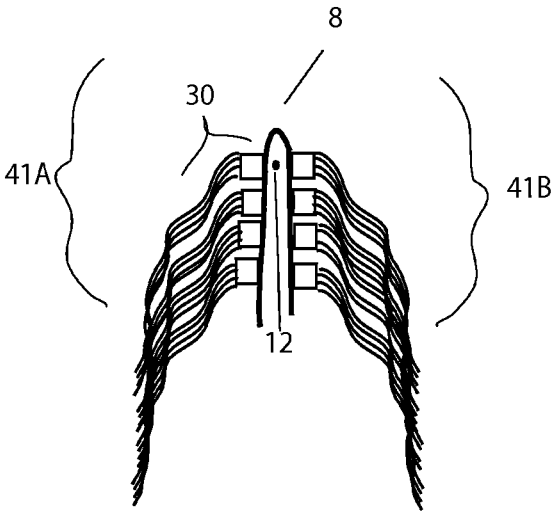

Since other modifications and changes varied to fit particular operating requirements and environments will be apparent to those skilled in the art, the invention is not considered limited to the examples chosen for purposes of disclosure, and covers all changes and modifications which do not constitute departures from the true spirit and scope of this invention. For example, although an embodiment where the hair wefts are sewn together to form a flap was disclosed, an embodiment of the invention which utilizes lace or ribbon could be created. In such an embodiment, a plurality of hair wefts could be attached to a ribbon or to lace. Such a configuration may be easier for certain machines to make. FIG. 14A-14B illustrate such an embodiment, where the wefts are attached to the lace 8 without layering. In this embodiment the wefts 30 may be sewn, glued, or otherwise fastened to the lace 8 or ribbon. In this configuration, a length of lace having a length approximately equal to twice the length of one of the hair flaps is used, wherein the hair wefts are not fasted to each other, but are fastened to the lace instead. The width of the lace may be approximately equal to the width of the hair flap. To finish the construction, the flaps 41A and 41B would be brought together (FIG. 14B) sandwiching the filament.

Having thus described the invention, what is desired to be protected by Letters Patent is presented in the subsequently appended claims:

1. A hair extension device comprising a filament and a hair flap:

the hair flap comprising at least three hair wefts, each weft comprising a width, length, and depth; said hair flap comprising a thickness formed by the depths of the hair wefts; said hair wefts comprise hair strands attached together by seams which compose a band; said hair wefts having a weight;

the filament comprising a circular or elliptical cross section; wherein the filament is attached to the hair flap, and the filament is configured to be situated on the crown of the user's head to support the hair extension device; the filament forming an elliptical or circular shape with the hair flap; and wherein the filament and the weight of the hair wefts allow the hair extension device to be set upon and maintained on the head of the user without the need for additional securing measures.

2. The device of claim 1, wherein the wefts each comprise hundreds of individual hairs strands.

3. The device of claim 1, wherein the hair strands having a length, a top portion, and a bottom portion; and the hair strands are arranged in a parallel manner and bound together near the top portion of the strands to form the weft.

4. The device of claim 3, wherein the bottom portion of the hair strands are configured to blend in with the user's natural hair when the device is worn.

5. The device of claim 3, wherein the band generally extends in a direction orthogonal to the seam

6. The device of claim 3, wherein the weft comprises a depth containing many hair strands, a length equal to the length of the hair strands, and a width between 7-12 inches.

7. The device of claim 1, wherein the wefts are layered one on top of the other to form a staircase profile.

8. The device of claim 1, wherein the wefts are layered one on top of the other using a non-overlapping technique, wherein there is no overlap of the bands in the hair flap.

9. The device of claim 1, wherein the wefts are layered one on top of the other using an overlapping technique, wherein there is a partial overlap of the bands in the hair flap.

10. The device of claim 1, wherein the wefts are not connected back-to-back.

11. The device of claim 1, wherein the filament is not a flat band, ribbon, or strap.

12. The device of claim 11, wherein the filament is transparent

13. The device of claim 11, wherein the filament is fishing line.

14. The device of claim 11, wherein there is only one filament supporting the weight of the hair wefts.

15. The device of claim 1, wherein the device consists of the filament and the hair flap.

* * * * *